US009216427B2

(12) United States Patent
Grant

(10) Patent No.: US 9,216,427 B2
(45) Date of Patent: Dec. 22, 2015

(54) FLUID DISTRIBUTING DEVICE AND METHOD

(75) Inventor: Stuart F. Grant, Long Beach, CA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 843 days.

(21) Appl. No.: 12/068,908

(22) Filed: Feb. 13, 2008

(65) Prior Publication Data

US 2008/0203190 A1 Aug. 28, 2008

Related U.S. Application Data

(60) Provisional application No. 60/901,562, filed on Feb. 14, 2007.

(51) Int. Cl.

| | |
|---|---|
| ***B05B 3/00*** | (2006.01) |
| ***B05B 3/02*** | (2006.01) |
| ***B05B 3/04*** | (2006.01) |
| ***B05B 1/34*** | (2006.01) |
| ***B05B 3/06*** | (2006.01) |

(52) U.S. Cl.

CPC ..... *B05B 3/0486* (2013.01); *B05B 3/06* (2013.01)

(58) Field of Classification Search

CPC ..... B05B 3/06; B05B 3/0486; B05B 3/0463; B05B 3/00; B05B 3/008; F16C 32/0427; F16C 39/063; F16C 2360/23; F16C 2240/12; F16C 32/04; H02N 15/00

USPC ..... 239/225.1, 222.21, 233, 236, 383, 239/222.17, 222.11, 222, 229, 243, 382, 239/381, 380, 498, 389, 222.15; 335/285, 335/286, 294; 446/131; 310/90.5

See application file for complete search history.

(56) References Cited

U.S. PATENT DOCUMENTS

| | | | | |
|---|---|---|---|---|
| 2,535,469 | A | | 12/1950 | Wanke |
| 2,582,788 | A | | 1/1952 | Mendelsohn |
| 2,848,276 | A | | 11/1956 | Clearman |
| 3,034,728 | A | | 6/1960 | Hruby, Jr. |
| 3,009,648 | A | * | 11/1961 | Hait ..... 239/201 |
| 3,168,596 | A | * | 2/1965 | Jamison ..... 261/89 |
| 3,532,273 | A | | 5/1968 | Siddal et al. |
| 3,493,275 | A | * | 2/1970 | Emslie et al. ..... 310/90.5 |
| 3,550,936 | A | * | 12/1970 | Puttick ..... 472/57 |
| 3,871,582 | A | | 3/1975 | Biddle |
| 3,958,643 | A | | 5/1976 | Landsberg |

(Continued)

OTHER PUBLICATIONS

International Search Report on Feb. 27, 2006, in PCT/US2005/039732, filed Nov. 3, 2005.

(Continued)

*Primary Examiner* — Len Tran
*Assistant Examiner* — Steven M Cernoch
(74) *Attorney, Agent, or Firm* — Nixon & Vanderhye P.C.

(57) ABSTRACT

A system for deflecting and distributing liquid from a liquid source is provided. The system comprises a deflector turbine element incorporated at one end of a cylindrical rotor which encloses at least a portion of the nozzle and is guided coaxially along the nozzle by at least one guide ring. The turbine element fixed to the rotor cylinder further comprises at least one diagonal groove configured to receive and deflect the liquid. The rotor or spindle element is configured to spin relatively freely around the nozzle (hollow shaft) and is allowed to reposition up or down along the nozzle shaft limited by the force of the water jet in one direction and a repelling magnetic force in the opposite direction.

16 Claims, 4 Drawing Sheets

(56) References Cited

U.S. PATENT DOCUMENTS

| | | | | |
|---|---|---|---|---|
| 3,964,685 | A | 6/1976 | Chauvigne | |
| 4,073,438 | A | 2/1978 | Meyer | |
| 4,487,368 | A | 12/1984 | Clearman | |
| 4,763,839 | A * | 8/1988 | Greenberg | 239/222.17 |
| 5,188,555 | A * | 2/1993 | Zbegner | 446/133 |
| 5,381,960 | A * | 1/1995 | Sullivan et al. | 239/222.21 |
| 5,439,174 | A | 8/1995 | Sweet | |
| 5,588,595 | A | 12/1996 | Sweet et al. | |
| 5,626,674 | A * | 5/1997 | VanKuiken et al. | 118/317 |
| 5,671,885 | A | 9/1997 | Davisson | |
| 5,950,927 | A * | 9/1999 | Elliott et al. | 239/222.21 |
| 6,092,739 | A * | 7/2000 | Clearman et al. | 239/237 |
| 6,129,293 | A | 10/2000 | Jager | |
| 6,176,440 | B1 * | 1/2001 | Elliott | 239/222.21 |
| 6,255,752 | B1 * | 7/2001 | Werner | 310/90.5 |
| 6,267,299 | B1 | 7/2001 | Meyer | |
| 6,360,965 | B1 * | 3/2002 | Clearman et al. | 239/222.19 |
| 6,382,525 | B1 * | 5/2002 | Santiesteban et al. | 239/222.11 |
| 6,431,475 | B1 | 8/2002 | Williams | |
| 6,439,477 | B1 * | 8/2002 | Sweet et al. | 239/222.17 |
| 6,610,369 | B2 * | 8/2003 | Byrnes et al. | 427/449 |
| 6,766,967 | B2 * | 7/2004 | Harris et al. | 239/251 |
| 6,886,757 | B2 * | 5/2005 | Byrnes et al. | 239/84 |
| 6,902,768 | B2 * | 6/2005 | Smith et al. | 427/449 |
| 6,932,279 | B2 * | 8/2005 | Burcham | 239/222.17 |
| 7,070,122 | B2 * | 7/2006 | Burcham et al. | 239/231 |
| 7,143,957 | B2 * | 12/2006 | Nelson | 239/222.21 |
| 7,859,157 | B2 * | 12/2010 | Baur | 310/90.5 |
| 2006/0006253 | A1 * | 1/2006 | Nelson | 239/214 |
| 2006/0091232 | A1 | 5/2006 | Grant | |
| 2011/0074237 | A1 * | 3/2011 | Smoot et al. | 310/90.5 |
| 2012/0038232 | A1 * | 2/2012 | Aronstam et al. | 310/90.5 |

OTHER PUBLICATIONS

Grant, entitled, "Water Deflection Subassembly," U.S. Appl. No. 60/784,295, filed Mar. 21, 2006, pending.

Grant, entitled, "Fluid Distributing Device and Method," U.S. Appl. No. 60/901,562, filed Feb. 14, 2007, pending.

Grant, entitled, "Water Deflection Subassembly," U.S. Appl. No. 11/266,054, filed Nov. 3, 2005, pending.

U.S. Appl. No. 12/225,177, filed Sep. 16, 2008 (pending).

* cited by examiner

FLUID DISTRIBUTING DEVICE AND METHOD

Priority is claimed from U.S. Provisional Application Ser. No. 60/901,562, filed Feb. 14, 2007.

BACKGROUND OF THE INVENTION

This invention relates generally to a device for distributing a stream of water or other liquid in a desired orderly spray in a manner that will conserve a volume of the fluid expelled over an area per unit time. In particular, the device is configured to control a flow of a liquid such as water through a reliable mechanism suitable for spreading relatively small amounts of the liquid without need for a frictional thrust bearing and without interference to the dispersal pattern from a rotor-retaining frame or member.

Sprinklers of various types and sizes are used in a number of environments. One common example is a sprinkler system of the type used to water a lawn. The challenge in watering a lawn is, of course, to achieve a relatively even dispersion of water from a point source. Different sprinklers surmount this obstacle using different methods. One simple example of a sprinkler system is the spinning rotor turbine type of sprinkler. In this type of sprinkler, an axial jet of water is emitted from an axial nozzle and is intercepted and deflected laterally in all directions by a spinning rotor which is rotatably mounted on a thrust bearing that is in concentric alignment with the axial nozzle.

In such devices, the flow of water therefrom produces a reactive force that turns the water-dispersing rotor to evenly distribute the water. Such systems operate fairly well for many applications, especially in environments where there is little chance of unwanted debris entering into the rotor thrust bearing, and where it is not particularly disadvantageous for a sprinkler or a shower head to miss one or more sections within the area pattern due to interference from the rotor's retaining bridge or frame member.

Unfortunately, such prior art water dispersion and sprinkler systems require a thrust bearing and also a frame or a bridge surrounding a portion of the rotor to maintain the rotor in position. These thrust bearings are susceptible to malfunction due to trapped debris and the rotor-retaining members interfering with the passing water stream emitted from the spinning rotor. Such interference creates one or more areas in the dispersal pattern that are either dry or under-watered. These prior art devices are also less than optimal in locations where an abundance of small insects are present which might clog the bearing, or in applications such as shower heads and even greenhouse sprinklers where one might find a swath of unwatered seedlings. Also, the larger volume of water required to overcome thrust bearing friction to rotate the rotors in prior art designs is often more water volume than is desired for a given area, such as is often the case with steep hillsides that are susceptible to wasteful water runoff.

BRIEF DESCRIPTION OF THE INVENTION

According to a preferred but nonlimiting embodiment of the invention, a method and device for deflecting and distributing water from a source is provided. The device includes a fixed, linearly-extending nozzle of cylindrical configuration, formed with a through-going bore for expelling a liquid jet of water along the longitudinal axis thereof. A cylindrical, free-spinning rotor subassembly is mounted external to, and concentric with the nozzle. The rotor has at least one deflecting groove configured at a distal end of the cylindrical rotor to receive and deflect the water jet stream laterally, and thereby wet the surrounding areas.

In the preferred but nonlimiting embodiment, the rotor subassembly "floats", i.e., is suspended by use of a magnetic bearing composed of at least two opposing-polarity ring magnets. A first ring magnet is affixed to the distal end of the nozzle. A second ring magnet is affixed to the distal end of the rotor. The device is configured to operate with the first ring magnet acting to oppose the second ring magnet such that a force is directed upon the rotor in a direction generally equal and opposite to that of the force generated by the water flow.

The major portion of the rotor subassembly is a simple cylinder, larger in diameter than the nozzle, and arranged concentrically about the nozzle. More specifically, the rotor may be loosely fitted coaxially around the nozzle (shaft) and thus may freely spin and move axially along the nozzle, in one direction constrained by force from the impinging water jet, and constrained from the other direction by force from the magnetic fluid of the opposing magnet pair. The turbine portion of the rotor is a press-fitted element on one end of the cylinder at a distal end of the device and is made with an axially-extending inlet configured to receive the vertical liquid stream and deflect it laterally, to thereby wet the surrounding areas. Thus, in one aspect, the invention relates to a sprinkler device for distributing a liquid stream, comprising: an elongated stationary nozzle having a longitudinal axis; an elongated rotor partially enclosing the nozzle, moveable in opposite axial directions along the axis, and rotatable relative to the axis; at least one deflector turbine attached to a downstream end of the rotor; at least one set of magnets within the rotor, attached to the nozzle and the rotor, respectively, and maintaining the rotor axially spaced from the stationary nozzle; wherein liquid emitted from the nozzle passes through the deflector turbine; and further wherein the deflector turbine is formed such that the liquid stream causes the deflector turbine and rotor to rotate about the axis.

In another aspect, the invention relates to a sprinkler assembly comprising: a fixed, elongated nozzle; a substantially cylindrical rotor at least partially enclosing the nozzle and having a liquid deflector at one end thereof, the rotor moveable both axially and rotatably relative to the nozzle; a pair of guide rings located within the rotor, the guide rings having openings through which the nozzle passes, one of the guide rings comprising a first magnet; and a second magnet fixed to the nozzle and located axially between the guide rings, with like poles of the first and second magnets facing each other.

The preferred but nonlimiting embodiments of this invention, illustrating all its features, will now be discussed in detail. These embodiments depict the novel and nonobvious methods and systems of this invention shown in the accompanying drawings, which are for illustrative purposes only.

BRIEF DESCRIPTION OF THE DRAWINGS

The drawings include the following figures, with like numerals indicating like parts.

DETAILED DESCRIPTION OF THE INVENTION

In one exemplary but nonlimiting embodiment of the invention, a reliable water deflection subassembly is disclosed that can be used to disperse water or other liquids (or solids or gases, or solids and gases combined as in the case of seed distribution devices) without interference from a rotor-supporting bridge. In order to do so, a channeled water-diverting rotor is employed, having one or more grooves disposed on its deflecting surface. As an axial liquid jet issues from the nozzle and contacts the deflecting surface, the rotor is caused to spin on its longitudinal axis. The rotor may be suspended in a relatively frictionless environment by use of opposing ring magnets. As a result, neither a conventional frictional thrust bearing nor a rotor-retaining bridge are required or used. As the rotor spins, water contacting the turbine is deflected from the rotor at different angles, and the water is thereby dispersed without interference from a rotor-retaining bridge.

Figure 1:
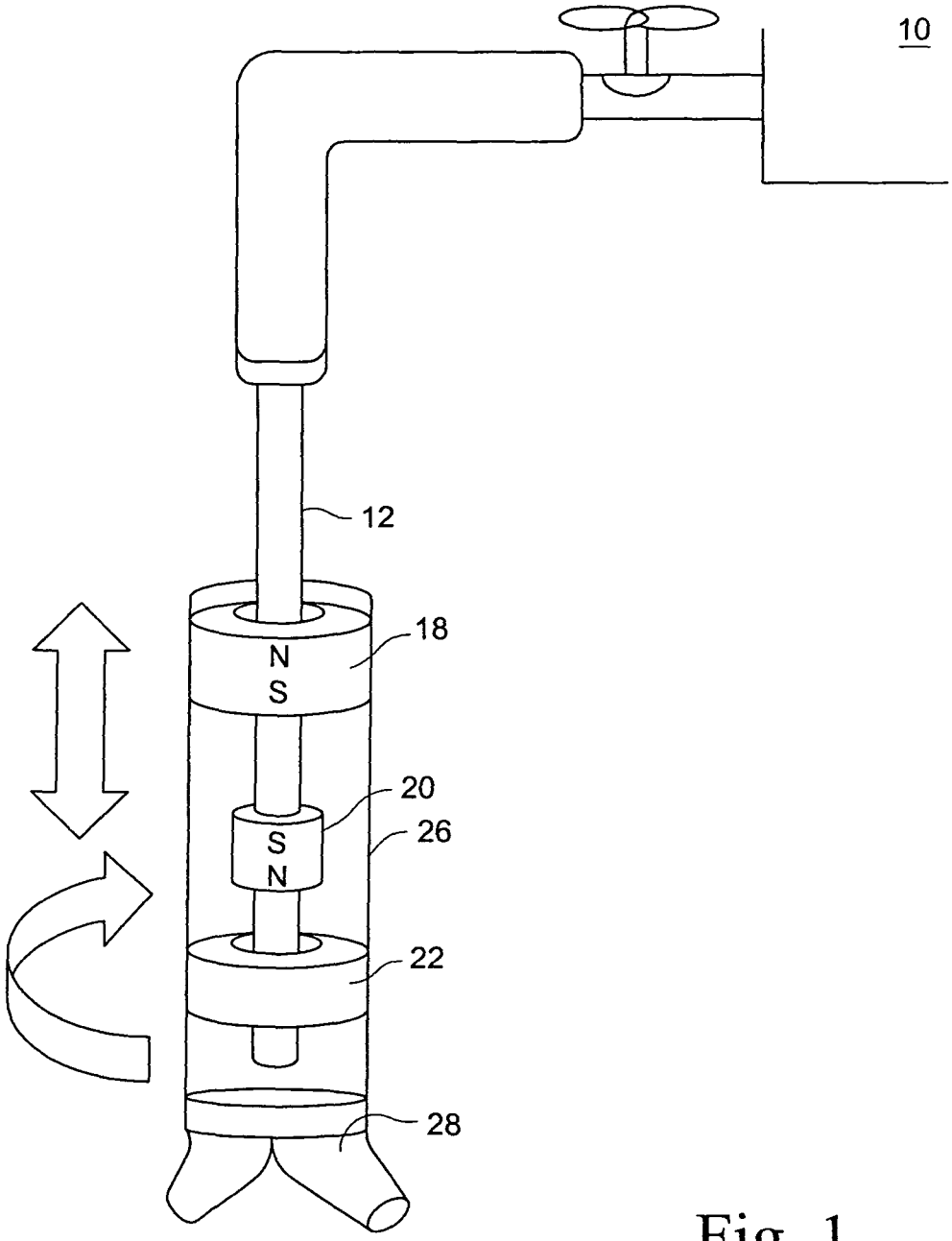
FIG. 1 shows a perspective view of a water deflection subassembly according to one embodiment of the present invention.

FIG. 1 illustrates one embodiment of a water deflection subassembly 10. As illustrated, the water deflection subassembly 10 comprises a hollow rod-like nozzle (or nozzle shaft) 12, two opposing ring magnets 18, 20, a cylindrical rotor (or "rotor sleeve" or "rotor cylinder") 26 with a deflector turbine 28 formed at or inserted in one end, and a guide ring 22.

A deflector turbine 28 may be pressed into a distal end of the rotor cylinder 26 and is located just below the outlet of the nozzle 12 which represents the point source of water that should be dispersed. The deflector turbine 28 includes one or more outlet passages that are arranged to cause rotation of the rotor cylinder 26 as liquid is emitted from the outlet orifices of the deflector turbine 28. The rod-like nozzle 12 is preferably fixed along the central axis of the subassembly 10 such that the initially emitted water jet flows along the central axis of the subassembly 10. Of course, in other embodiments, the deflected liquid need not be water, but may be any of a number of liquids. For example, the liquid may comprise biological broths or liquid chemicals undergoing heat-generating reactions that may be advantageously cooled or oxidized as they form droplets dispersed through the air. As shown in FIG. 1, the liquid flowing from the water jet is propelled by gravity. However, in other embodiments, a variety of pumps or other means for moving water against gravity may be used to propel the water towards the water deflection subassembly 10.

The rod-like nozzle 12 loosely guides the externally floating rotor cylinder 26 which is coaxially suspended around it. The inside diameter of the rotor guide ring 22 and the rotor-attached ring magnet 18 fixed within the rotor subassembly, are of larger diameter than the nozzle diameter, allowing the rotor cylinder 26 to spin freely and floatingly along the longitudinal axis of the nozzle shaft. The rotor cylinder 26 is thus allowed a range of axial motion along the nozzle shaft 12, restrained within limits from one direction by the force of the opposing magnet pair and restrained from the other direction by the force of the impinging water stream.

In the illustrated embodiment of FIG. 1, the deflector turbine 28 is attached at a distal end of the rotor cylinder 26 and hangs suspended just below the nozzle opening. The rotor cylinder 26 may be constructed from any of a number of rigid materials and has an inside diameter greater than the nozzle shaft 12 such that the rotor 26 accommodates the ring magnet 18 and the guide ring 22 as described above.

As noted above, the rotor cylinder 26 contains the guide ring 22, the ring magnet 18, and the deflector turbine 28. The guide ring and deflector turbine may be constructed of the same or different materials as the rotor cylinder, and are preferably constructed from a rigid or semi-rigid material having a relatively low coefficient of friction. The guide ring 22 and ring magnet 18 may also be centered about the same axis and concentric about the nozzle 12. As illustrated, the guide ring 22 and rotor-attached ring magnet 18 have identical internal and external radii and are concentric about the same longitudinal axis. Of course, more or fewer rings may be used in other embodiments. For example, in another embodiment a third ring may be used to provide further security for the nozzle shaft 12 and deflector turbine 28.

In another embodiment, the rotor cylinder 26 may not be a separate element but may be formed integrally with guide rings and deflector turbine 28.

In the illustrated embodiment, the deflector turbine 28 is attached to a lower end of the cylinder 26 of the rotor subassembly and guide ring 22 and ring magnet 18 are fixed along the inside axis of rotor cylinder 26 thus guiding the rotor 26 along the nozzle 12 and allowing the rotor 26 to spin freely about the nozzle.

The rotor 26 may also be constructed from any of a number of rigid materials and has a length greater than the distance between the retaining rings.

As illustrated, the ring magnet 18 has its south pole facing downwards, and its north pole facing upwards. Of course, these polarities may be otherwise disposed in other embodiments. The ring magnet 18 may comprise any of a number of magnetic materials well known to those of skill in the art. In a preferred embodiment, the ring magnet 18 comprises a neodymium magnetic material.

The ring magnet 18 is attached to the interior of the rotor cylinder 26, but may also be attached at various other locations, more or less proximal to the deflector turbine 28.

Located along the nozzle 12 below the concentric ring magnet 18 fixed inside the cylinder, another ring magnet 20 may be fixed along the nozzle 12, and oriented to oppose the magnet 18 attached to the rotor. Thus, the rotor subassembly is lifted upwards and the deflector turbine 28 hangs suspended just below the nozzle opening.

The opposing magnet pair allows the rotor cylinder 26 and deflector turbine 28 to remain suspended with relatively little friction impeding their spinning.

The embodiment of FIG. 1 will now be described in operation. In an inactive state, opposing magnetic forces between the two ring magnets 18, 20 suspends the cylindrical rotor 26 coaxially around the nozzle 12, and the water deflector turbine 28 of the rotor hangs just below opening of the nozzle 12.

When water is emitted from the nozzle 12, it contacts the deflector turbine 28 as shown. The water then flows along the deflecting channels in the turbine, and the weight of the water (and the force with which the water contacts the angled walls of the deflector turbine) spins the rotor cylinder 26. Since the deflecting channels of the deflector turbine 28 are oriented diagonally along the deflector turbine, the force from the water may also impart a tangential component to the deflector turbine 28, thus spinning the rotor 26 about the nozzle 12.

As soon as the water starts to contact the deflector turbine 28, the rotor also experiences an additional downward force, and thus the rotor cylinder 26, attached guide ring 22, attached ring magnet 18 and deflector turbine 28 are reoriented to a lower position along the vertical axis of the nozzle 12 relative to its inactive state.

As rotor 26 spins on its longitudinal axis about the nozzle 12, the water flowing from the nozzle 12 is deflected off the rotor via the deflector turbine 28 and is thereby distributed at various angles around the subassembly 10. Since the function of a thrust bearing is accomplished by the repelling force between the nozzle-attached magnet 20 and the rotor-attached magnet 18, a conventional thrust bearing is not employed, and no rotor-supporting member is required. In other words, when operating, there is no bearing engagement at either end of the rotor. As a result, debris sand and/or insects are much less likely to interfere with the rotation of the rotor, and, because only a relatively small amount of friction is experienced, very little water flow is required to drive the simple deflector turbine. In addition, water droplets are not sheared into smaller spray droplets by thrust bearing friction, and the water stream is able to travel further in a lateral direction because less deflection of the stream is required to move the floating rotor.

Figure 2:
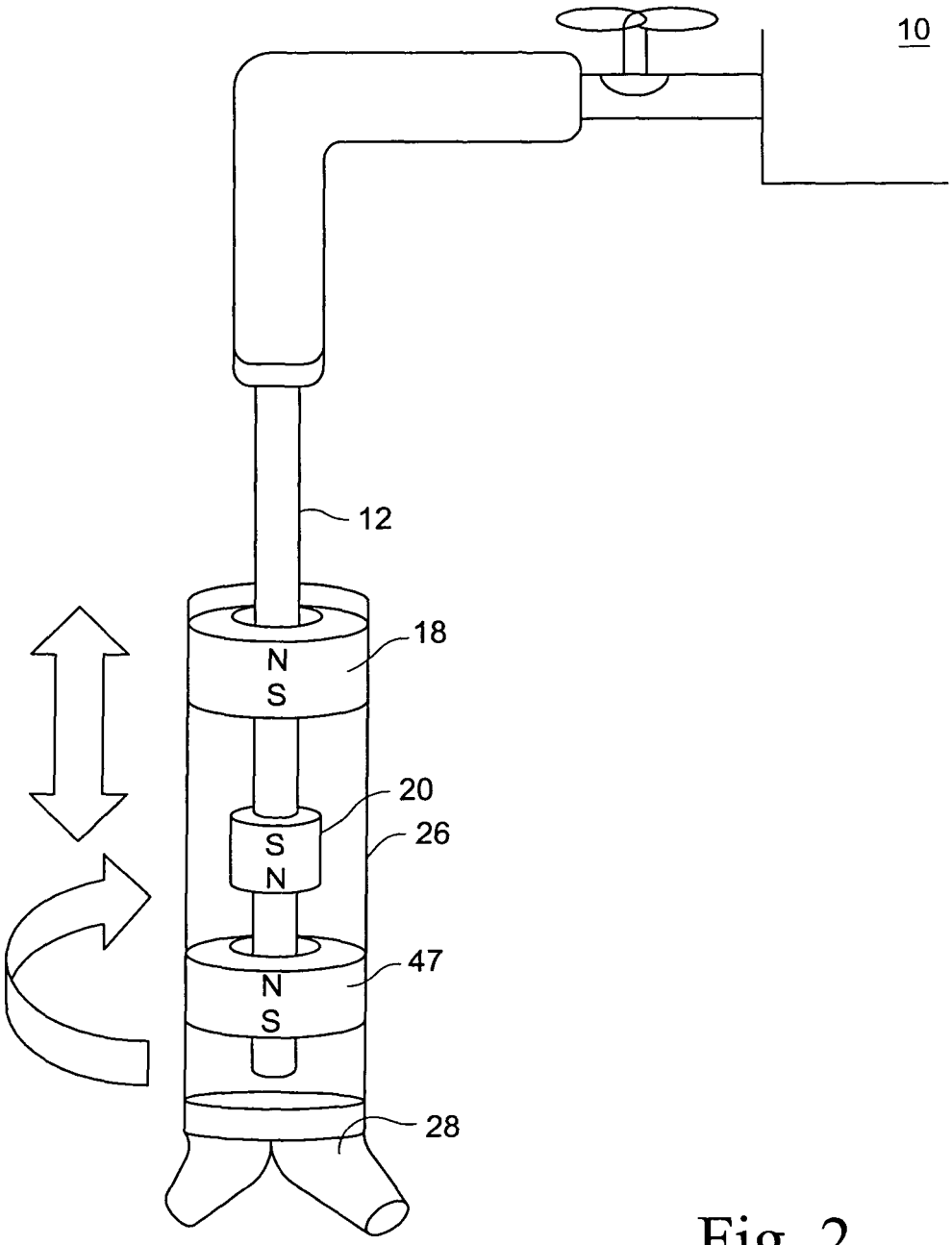
FIG. 2 shows a perspective view of a water deflection subassembly according to a second embodiment of the present invention.

FIG. 2 illustrates yet another embodiment of a water deflection subassembly 10. As illustrated, the water deflection subassembly 10 may comprise a rod-like nozzle 12, two opposing ring magnets 18, 20, a cylindrical rotor 26 with a deflector turbine 28 inserted at one end and a second guide ring 22.

An additional ring magnet 47 is fixed to the interior surface of the rotor 26 and also acts to guide the rotor axially along the rod-like nozzle 12. Ring magnet 47 opposes ring magnet 20 from the opposite direction, thus preventing rotor 26 from seating against nozzle 12 while subassembly 10 is at rest. This configuration ensures a very low friction environment during startup of subassembly 10.

Figure 3:
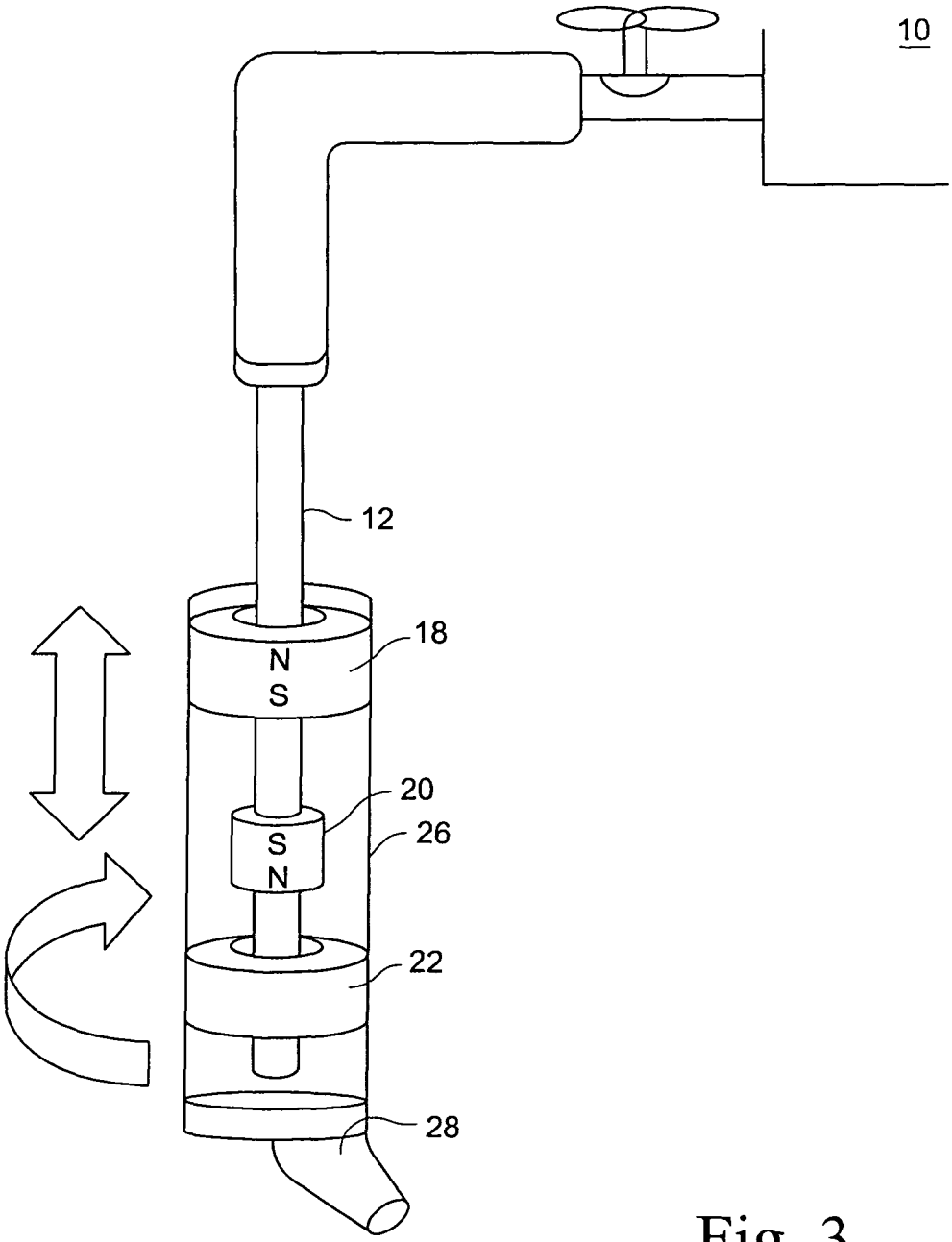
FIG. 3 shows a perspective view of a water deflection subassembly according to a third embodiment of the present invention.
Figure 4:
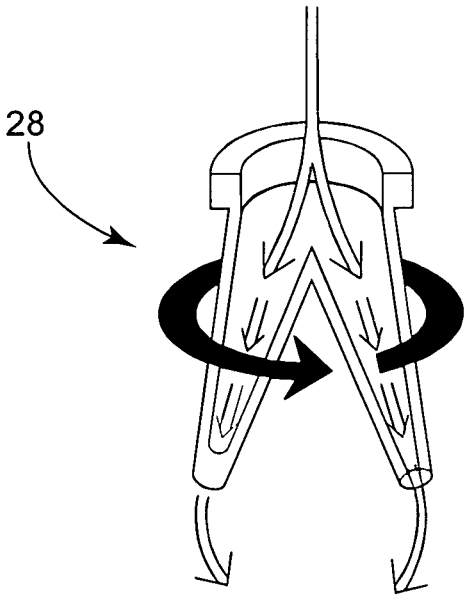
FIG. 4 shows a perspective view of the water dispersing turbine portion of the rotor assembly.

FIG. 3 illustrates yet another embodiment of a water deflection subassembly 10. In this embodiment, the deflector turbine 28 has only one lateral fluid outlet rather than two or three or more, making this configuration more adaptable to distributing a fluid in a partial circle pattern if desired. In other embodiments deflector turbine 28 may have any number of outlets.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. It also is contemplated that various aspects and features of the invention described can be practiced separately, combined together, or substituted for one another, and that a variety of combinations and sub-combinations of the features and aspects can be made that still fall within the scope of the invention. Moreover, the different elements of these subassemblies 10 may be constructed from a number of different suitable materials well known to those of skill in the art, including rustproof metallic surfaces, polymeric surfaces, ceramics, and other materials. Thus, it is intended that the scope of the present invention herein disclosed should not be limited by the particular disclosed embodiments described above.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sprinkler device for distributing one or more a liquid streams, comprising:

an elongated stationary nozzle having a longitudinal axis, said nozzle oriented to emit a stream along said longitudinal axis;

an elongated rotor partially enclosing said nozzle and mounted for movement, in use, relative to said nozzle, in opposite axial directions along said axis, and for rotation about said axis;

at least one deflector turbine attached to a downstream end of said rotor and adapted to emit one or more streams of liquid supplied by said nozzle, said deflector turbine formed such that a liquid emitted from the nozzle and passing through said deflector turbine causes said deflector turbine and said rotor to rotate about said nozzle;

a first stationary magnet attached to said nozzle within said rotor, and a second annular ring magnet attached to said rotor, said first and second magnets having like poles facing each other thereby exerting an axial force on said rotor in a direction counter to an axial force exerted on said rotor by the liquid emitted from said nozzle, such that in use, said first and second magnets cause said rotor to float axially along said elongated nozzle as said rotor rotates about said longitudinal axis; and a guide ring attached to said rotor downstream of said first magnet with said first magnet sandwiched between said second magnet and said guide ring, said guide ring being rotatable with said rotor relative to said nozzle.

2. The device as claimed in claim 1 wherein said second magnet is upstream of said first magnet relative to a flow direction of the liquid.

3. The device as claimed in claim 1, wherein said deflector turbine comprises a discrete pair of angled dispensing orifices.

4. The device as claimed in claim 1, wherein said rotor is substantially cylindrical.

5. The device as claimed in claim 1, wherein said fixed nozzle member is connected to a source of water under pressure.

6. The device as claimed in claim 1, wherein the second magnet and the guide ring are fixed to an inside surface of said rotor.

7. A sprinkler assembly comprising:

a fixed, elongated nozzle having a longitudinal axis, said nozzle oriented to emit a stream along said longitudinal axis;

a substantially cylindrical rotor at least partially enclosing said nozzle and having a liquid deflector at one end thereof, said rotor moveable in use, axially along said longitudinal axis and rotatably about said nozzle;

a pair of guide rings located within said rotor and connected to said rotor, said guide rings having openings through which said nozzle passes, one of said guide rings comprising a first magnet; and a second magnet fixed to said nozzle and located axially between said guide rings, with like poles of said first and second magnets facing each other; and wherein said one of said guide rings is located at a downstream end of said rotor.

8. The sprinkler assembly of claim 7 wherein said deflector is shaped to cause said rotor and said deflector to rotate when a liquid stream emitted from said nozzle is dispensed through said deflector, and to distribute the liquid radially away from said nozzle.

9. The sprinkler assembly of claim 7 wherein said first and second magnets create a repelling force that tends to move the rotor along said nozzle in a first axial direction, and wherein water emitted from the nozzle creates a substantially equal force that tends to move the rotor along said nozzle in a second opposite axial direction, thereby suspending the rotor on the nozzle without the use of any thrust bearings.

10. The sprinkler assembly of claim 7 wherein the other of said guide rings is located at an upstream end of said rotor.

11. The sprinkler assembly of claim 10 wherein said other of said guide rings comprises a third magnet with like poles of said second and third magnets facing each other.

12. The sprinkler assembly of claim 8 wherein said deflector includes at least two outlets.

13. The sprinkler assembly of claim 8 wherein said deflector includes a single outlet.

14. The sprinkler assembly of claim 7 wherein said nozzle comprises a hollow rod having a diameter less than inside diameters of said guide rings, thereby permitting said rotor to spin freely about said hollow rod and to move freely axially along said hollow rod.

15. The device as claimed in claim 1, wherein said guide ring comprises a third annular ring magnet, wherein said first magnet and said third annular ring magnet are arranged with like poles facing each other.

16. The sprinkler assembly of claim 7, wherein said guide rings are connected to an inside surface of said rotor.

* * * * *